US006339381B1

(12) United States Patent
Takikita

(10) Patent No.: US 6,339,381 B1
(45) Date of Patent: Jan. 15, 2002

(54) DSRC CAR-MOUNTED EQUIPMENT

(75) Inventor: Mamoru Takikita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/635,140

(22) Filed: Aug. 9, 2000

(30) Foreign Application Priority Data

Mar. 29, 2000 (JP) ..... 2000-091117

(51) Int. Cl.[7] ..... G08G 1/00
(52) U.S. Cl. ..... 340/901; 340/928
(58) Field of Search ..... 340/901, 902, 340/904, 928, 936, 441; 455/99, 134, 575

(56) References Cited

U.S. PATENT DOCUMENTS 3,996,554 A * 12/1976 Ives et al. ..... 340/901
5,581,249 A * 12/1996 Yoshida ..... 340/928
5,751,227 A * 5/1998 Yoshida et al. ..... 340/928
5,764,163 A * 6/1998 Waldman et al. ..... 340/928
5,933,096 A * 8/1999 Tsuda ..... 340/928
5,933,097 A * 8/1999 Sakurai et al. ..... 340/928
6,107,940 A * 8/2000 Grimm ..... 340/928

* cited by examiner

*Primary Examiner*—John Tweel, Jr.
(74) *Attorney, Agent, or Firm*—Sughrue Mion, PLLC

(57) ABSTRACT

A DSRC car-mounted equipment reliably preventing communication error in the communication area, comprising a communication control unit 11 for transmitting and receiving data by radio to and from an on-the-road equipment, a radio detector unit 12 for detecting signals received from the on-the-road equipment by detecting the electric field intensity E, and a microcomputer (10A) for fetching output signals from the radio detector unit by controlling the communication control unit to process data included in the received signals, wherein the microcomputer includes an input interface for receiving data Vr related to the speed of the vehicle, and communication area-setting means for variably setting the radio communication area depending upon the vehicle speed data, and wherein the communication area-setting means contracts the communication area when the vehicle speed data represents a low-speed state and expands the communication area when the vehicle speed data represents a high-speed state.

6 Claims, 6 Drawing Sheets

PRIOR ART

PRIOR ART

PRIOR ART

DSRC CAR-MOUNTED EQUIPMENT

BACKGROUND OF THE INVENTION

1. Field of the Invention

The present invention relates to a DSRC (dedicated short-range communication) car-mounted equipment used for an ETC (electronic toll collection) system in an ITS (intelligent transport system). More particularly, the invention relates to a DSRC car-mounted equipment which prevents communication error relative to an on-the-road equipment by setting an optimum communication area depending upon the vehicle speed data.

2. Prior Art

There has heretofore been known a DSRC car-mounted equipment (hereinafter also referred to simply as "car-mounted equipment") for transmitting and receiving a variety of data through communication with an on-the-road equipment installed on a road on which a vehicle travels, and has been used as, for example, an ETC car-mounted equipment.

FIG. 4 is a block diagram schematically illustrating the constitution of a conventional DSRC car-mounted equipment and illustrating, here, an ETC car-mounted equipment.

FIG. 5 is a diagram of characteristics showing electric field intensities received by the conventional DSRC car-mounted equipment, and FIG. 6 is a flowchart illustrating the communication operation between the on-the-road equipment and the car-mounted equipment using the conventional DSRC car-mounted equipment.

In FIG. 4, the car-mounted equipment 1 includes a microcomputer 10 for processing data received from the on-the-road equipment, a communication control unit 11 that operates in relation to the microcomputer 10, a radio detector unit 12 controlled by the communication control unit 11, and a storage medium interface 13 for sending and receiving a variety of data (such as toll collection data) to and from an external storage medium 2.

The external storage medium 2 may be an IC card having a car-mounted interface 20, and sends and receives data related to the toll collection to and from the microcomputer 10 in the car-mounted unit 1 through the storage medium interface 13.

Here, through not diagramed, the storage medium interface 13 interposed relative to the external storage medium 2 includes a physically mounted unit and a control unit (not shown) for reading data, and is allowed to be connected to various external equipment.

The conventional car-mounted equipment is constituted as shown in FIG. 4 and in which the microcomputer 10 controls the communication control unit 11 to transmit and receive real radio data to and from the on-the-road equipment (not shown) through the radio detector unit 12.

That is, the microcomputer 10 fetches the data received from the on-the-road equipment through the radio detector unit 12, and sends transmission data to the on-the-road equipment through a transmission unit (not shown).

The radio detector unit 12 in the car-mounted equipment 1 detects the radio electric field intensity transmitted from the on-the-road equipment, and informs the microcomputer 10 of the fact that the car is entering the area for communicating radio data for toll collection.

In the automatic toll collection system as is widely known, the state in which the external storage medium 2 is normally mounted on the car-mounted equipment 1 and the toll collection conformance of the external storage medium 2 are confirmed and, then, the radio communication is executed relative to the on-the-road equipment using the data within the communication area, in order to automatically collect the toll.

In the DSRC car-mounted equipment 1 of this kind, in general, the sensitivity for reception has been set constant irrespective of whether it is within the communication area or not. Therefore, the electric field intensity of the electromagnetic waves received from the on-the-road equipment varies depending upon the distance (position in a direction in which the vehicle is traveling) as shown in FIG. 5.

In FIG. 5, the abscissa represents the position (distance in the direction in which the vehicle is traveling) of the car-mounted equipment with respect to an antenna ANT of the on-the-road equipment, and the ordinate represents the intensity of electric field received by the car-mounted equipment 1. The communication start area (communication area) is set relying upon a relationship between the electric field intensity determined by the distance from the antenna ANT of the on-the-road equipment and a predetermined level (threshold) TH corresponding to the sensitivity for reception.

Here, the antenna ANT of the on-the-road equipment is installed at a toll collection gate of a toll expressway.

The communication area in which the data are exchanged after the vehicle has entered into the communication start area is set within about 4 meters from the antenna ANT of the on-the-road equipment.

Further, the communication area set by the predetermined level TH (sensitivity for reception) may include areas A, B where the electric field intensity so drops that the communication cannot be accomplished and unstable boundary areas due to side lobes in the output from the antenna ANT of the on-the-road equipment.

As the vehicle approaches the on-the-road equipment, the communication is repeated a plural number of times between the on-the-road equipment and the car-mounted equipment 1, and the on-the-road equipment repetitively transmit communication signals to the car-mounted equipment 1 at all times.

Next, the communication operation of the conventional DSRC car-mounted equipment will be described with reference to FIGS. 4, 5 and 6.

FIG. 6 illustrates the flow of the toll collection communication by taking into consideration the areas A, B where the electric field intensity drops.

In FIG. 6, first, the car-mounted equipment 1 approaches the on-the-road equipment 1 and enters into the system start area and where the electric field intensity received from the antenna ANT of the on-the-road equipment becomes greater than a system drive level (<predetermined level TH). Then, the system in the car-mounted equipment 1 is driven in response thereto (step S11).

Then, the car-mounted equipment 1 further approaches the antenna ANT of the on-the-road equipment, whereby the intensity of the received electric field exceeds the predetermined level TH and a first communication signal is received. Then, in response thereto, the car-mounted equipment 1 transmits communication signals to the antenna ANT of the on-the-road equipment and executes the initial communication for receiving the toll (step S12).

Then, it is judged whether the communication for receiving the toll is all completed between the on-the-road equipment and the car-mounted equipment 1 (step S13). When the communication signals are normally exchanged and it is judged that the communication has completed (i.e., YES), the routine normally ends in a state where the communication for collecting the toll has been finished (step S14).

When it is judged at step S13 that the communication for receiving the toll has not all been completed (i.e., NO), the on-the-road equipment repetitively transmits retrial communication signals for collecting the toll to the car-mounted equipment 1 (step S15).

Next, it is judged whether the communication is normal between the on-the-road equipment and the car-mounted equipment 1 (step S16). When it is judged that the communication is normal during the above retrial period (i.e., YES), the routine returns back to the step S13 and the processing is repetitively executed until it is confirmed that the toll collection communication has normally ended (step S14).

Here, the retrial communication operation by the on-the-road equipment is repeated about 100 to 200 times for every 2 milliseconds, and it is judged that the communication condition is normal when the vehicle enters into the communication-possible area (or when the vehicle leaves the boundary area).

At step S16, on the other hand, when the vehicle enters into the area A or B (or boundary area) where the electric field intensity drops and it is judged that the communication condition is not normal (i.e., NO), it is then judged whether the retrial communication period has elapsed (step S17).

When it is judged that the retrial period has not been elapsed (i.e., NO), the routine returns back to the step S13 to repeat the above-mentioned processings. When it is judged that the retrial period has elapsed (i.e., YES), it is so regarded that the communication for toll collection is impossible, and the routine abnormally ends (step S18).

That is, when there is quite no response from the car-mounted equipment 1 after it is confirmed that the car-mounted equipment 1 has entered into the communication area, the on-the-road equipment regards that the communication is impossible (car-mounted equipment 1 is not existing) and ends the communication.

Thus, as the electric field intensity detected by the radio detector unit 12 exceeds a predetermined level TH, the microcomputer 10 in the car-mounted equipment 1 informs that the car-mounted equipment 1 is within the communication area for collecting the toll and commences the communication operation.

As described above, however, the radio communication may be successful or unsuccessful in the areas A, B where the electric field intensity drops and in the boundary area where the electric field level is near the predetermined level TH for setting the received electric field intensity due to dispersion in the level of the electric field.

Further, the communication-impossible regions due to the areas A, B where the electric field intensity drops are greatly related to the vehicle speed.

That is, due to traffic jam or some trouble, the vehicle mounting the equipment 1 that has entered into the communication area (not smaller than the predetermined level TH) may stay long (or may move at a very low speed) in the areas A, B where the electric field intensity drops during the retrial communication (which is a period lasting for about 0.5 seconds) effected plural times.

Further, the vehicle running at a low speed due to the concentration of traffic may stay longer in the areas A, B where the electric field intensity drops, resulting in a succession of radio communication failure, causing the on-the-road equipment to so judge that the car-mounted equipment is abnormal making it difficult to automatically collect the toll.

In this case, when the predetermined level TH remains constant as shown in FIG. 5, the communication signals 3 are not received from the on-the-road equipment, and the state where there is no response from the car-mounted equipment 1 continues, spoiling the function of the car-mounted equipment.

Further, when the communication area is contracted by setting the predetermined level TH high in order to prevent the occurrence of inconvenience during the low-speed running, the vehicle that is running at a high speed stays short in the communication area, which may make it difficult to complete the communication within the communication area for collecting the toll.

According to the conventional DSRC car-mounted equipment as described above, the communication area is set in a fixed manner relative to the on-the-road equipment. Therefore, if the communication area is widely set, communication becomes impossible when the vehicle is traveling at a low speed being affected by the areas A, B where the electric field intensity drops. If the communication area is narrowly set, on the other hand, it becomes difficult to complete the communication within the communication area when the vehicle travels at a high speed. In either case, the car-mounted equipment cannot be effectively utilized.

SUMMARY OF THE INVENTION

The present invention was accomplished in order to solve the above-mentioned problems and has the object of providing a DSRC car-mounted equipment capable of reliably preventing communication error by variably setting the communication area depending upon the vehicle speed.

The DSRC car-mounted equipment according to the present invention comprises:

- a communication control unit for transmitting and receiving data by radio to and from an on-the-road equipment installed on a road on which a vehicle travels;
- a radio detector unit for detecting signals received from the on-the-road equipment by detecting the intensity of the radio electric field; and
- a microcomputer for fetching output signals from the radio detector unit by controlling the communication control unit to process data included in the received signals; wherein the microcomputer includes:

- an input interface for receiving data related to the speed of the vehicle, and
- communication area-setting means for variably setting the radio communication area depending upon the vehicle speed data; and wherein
- the communication area-setting means contracts the communication area when the vehicle speed data represents a low-speed state and expands the communication area when the vehicle speed data represents a high-speed state.

In the DSRC car-mounted equipment according to the invention, the communication area-setting means includes comparator means for comparing the intensity of the radio electric field with a predetermined judging level to determine the communication area, and increases the judging level when the vehicle speed data represents a low-speed state and decreases the judging level when the vehicle speed data represents a high-speed state.

In the DSRC car-mounted equipment according to the invention, the communication area-setting means changes the judging level in two steps by setting the judging level to a first judging level for low speed when the vehicle speed data represents a low-speed state, and setting the judging level to a second judging level for high speed when the vehicle speed data represents a high-speed state.

In the DSRC car-mounted equipment according to the invention, the communication area-setting means compares the vehicle speed data with a predetermined value corresponding to any speed within a range of from 5 km to 15 km per hour, contracts the communication area to become smaller than a normal communication area when the vehicle speed data is smaller than the predetermined value, and expands the communication area to become larger than the normal communication area when the vehicle speed data is not smaller than the predetermined value.

In the DSRC car-mounted equipment according to the invention, the communication area-setting means compares the vehicle speed data with a first predetermined value and with a second predetermined value larger than the first predetermined value, contracts the communication area to become smaller than a normal communication area when the vehicle speed data is smaller than the first predetermined value, and expands the communication area to become larger than the normal communication area when the vehicle speed data is larger than the second predetermined value.

The DSRC car-mounted equipment according to the invention further comprises an external storage medium connected to the microcomputer to exchange data related to the collection of the toll, wherein the microcomputer exchanges data related to the collection of the toll between the on-the-road equipment installed on a toll road and the external storage medium, and automatically executes the toll collection processing based on the data related to the collection of the toll.

DESCRIPTION OF THE PREFERRED EMBODIMENTS

Embodiment 1

An embodiment 1 of the invention will now be described with reference to the drawings.

Figure 1:
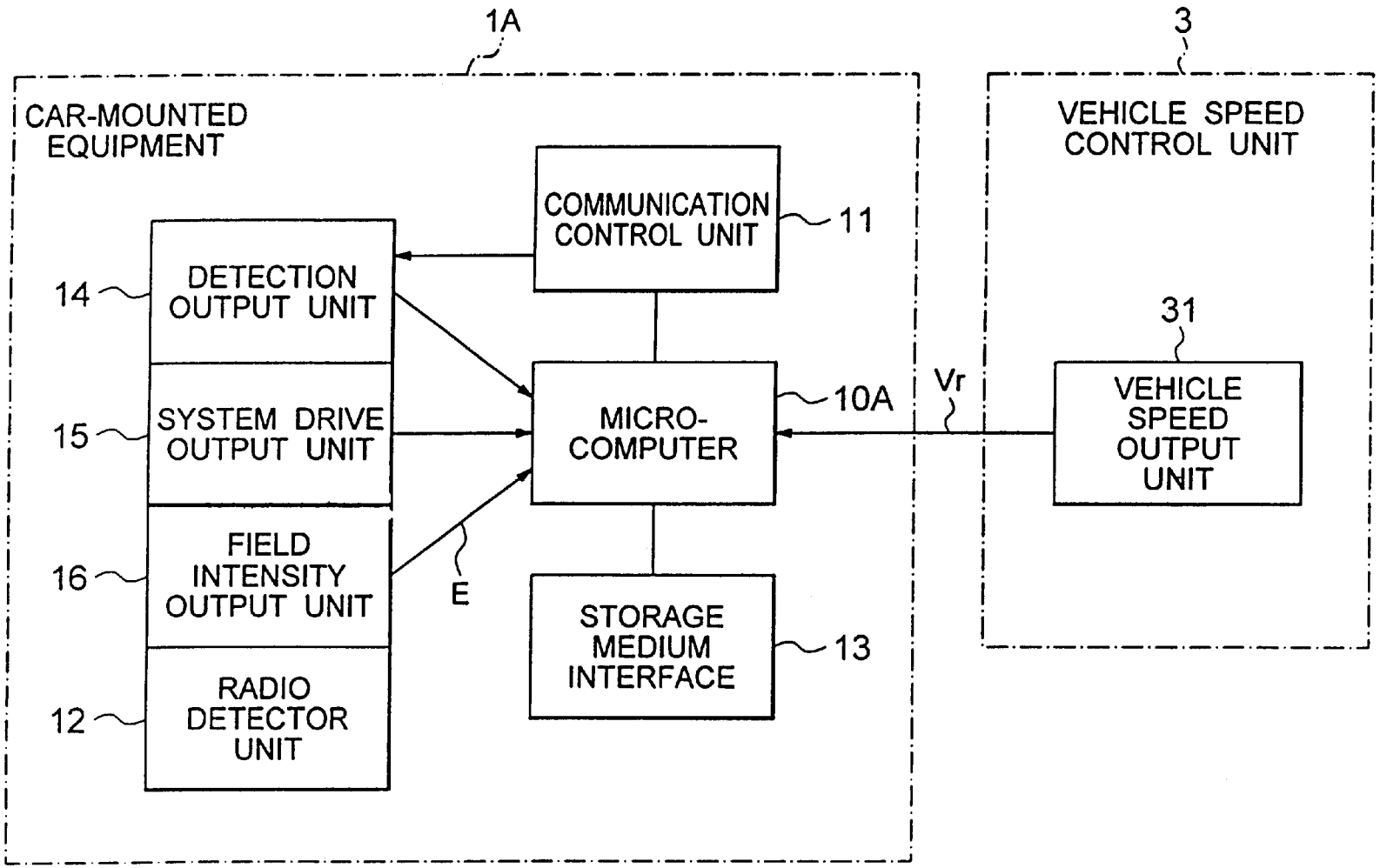
FIG. 1 is a block diagram schematically illustrating the constitution of an embodiment 1 of the present invention.
Figure 2:
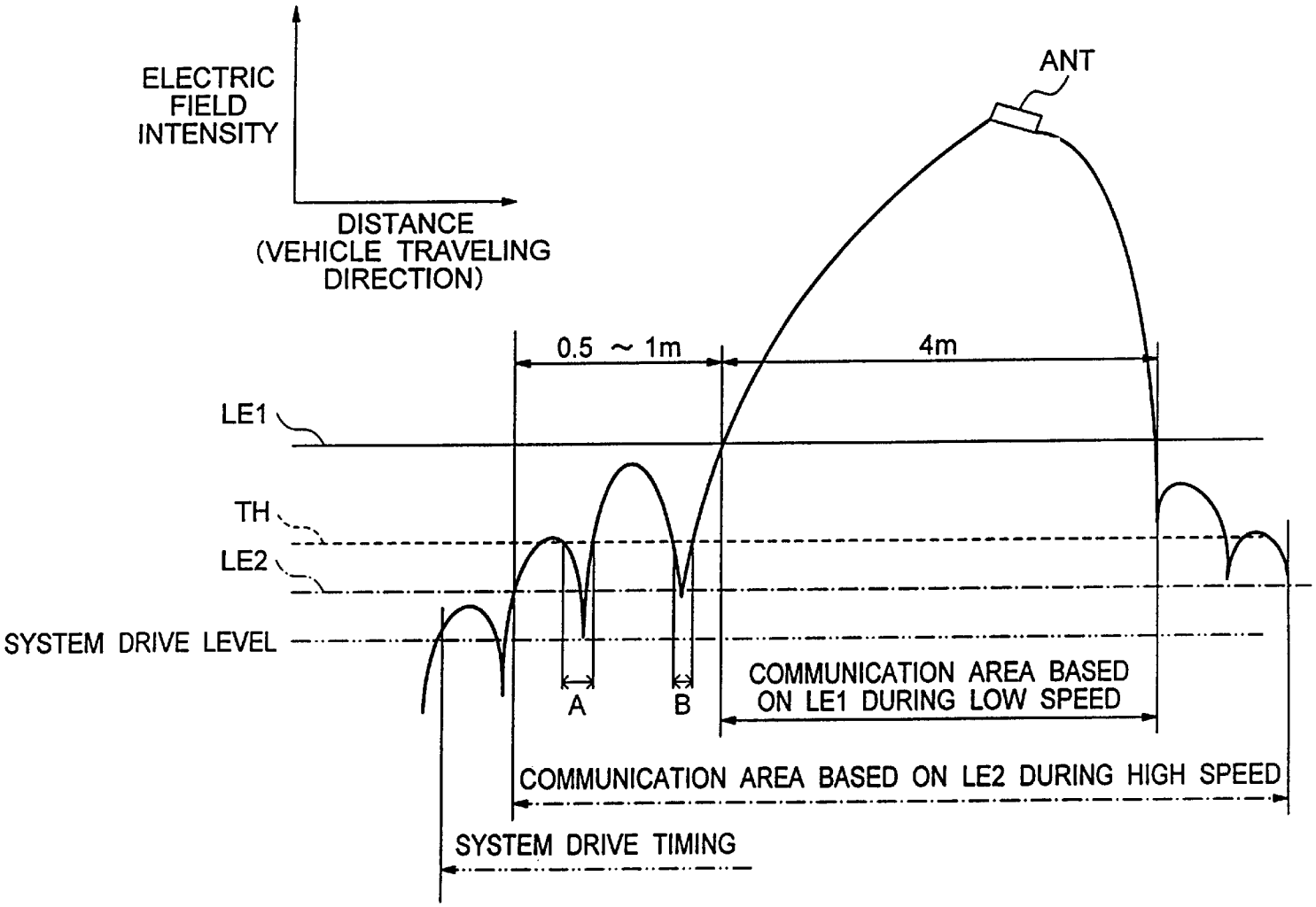
FIG. 2 is a diagram of characteristics showing the electric field intensity of the received signals according to the embodiment 1 of the invention.
Figure 3:
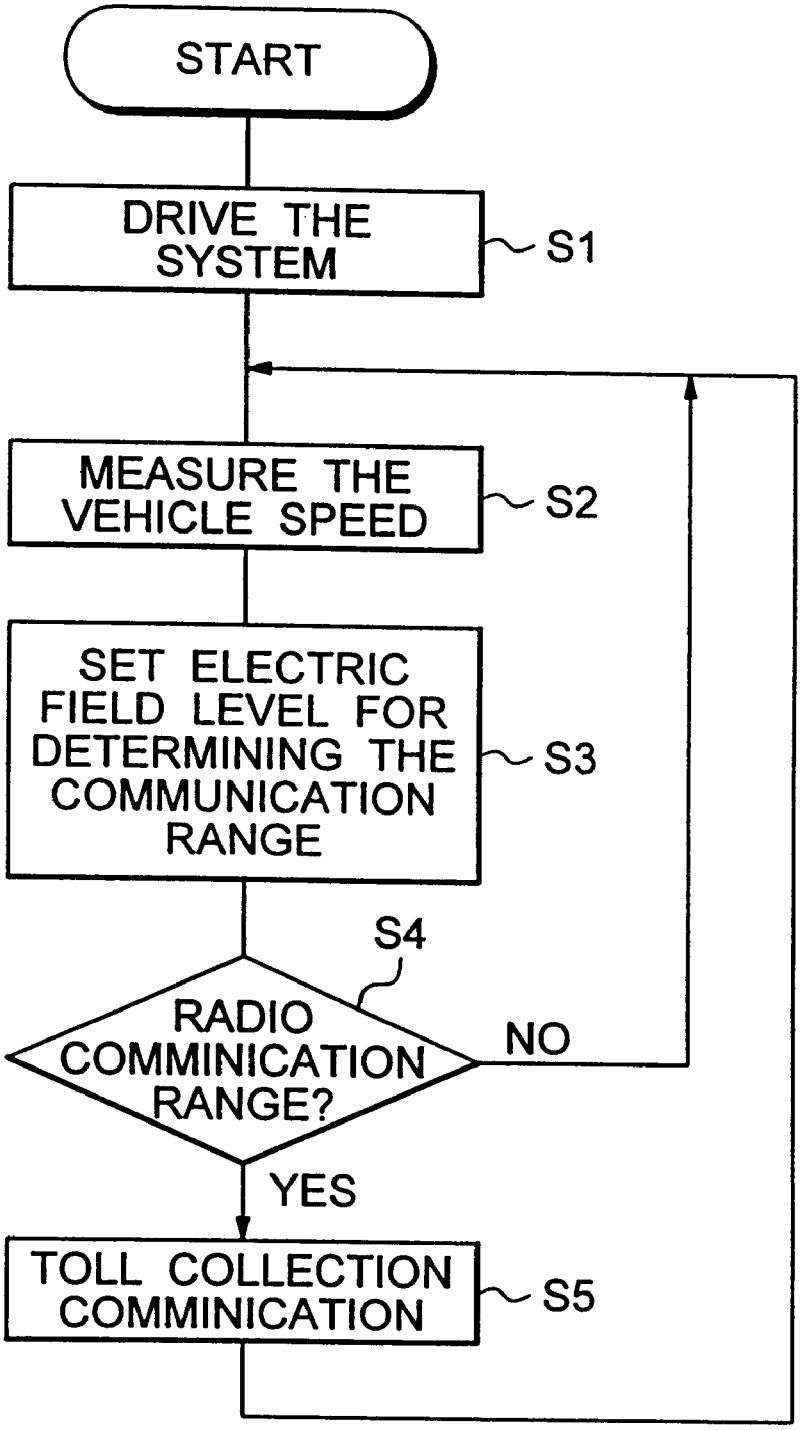
FIG. 3 is a flowchart illustrating the communication operation relative to the on-the-road equipment according to the embodiment 1 of the invention.

FIGS. 1 to 3 are diagrams for illustrating the embodiment 1 of the invention, wherein FIG. 1 is a block diagram schematically illustrating the whole constitution, FIG. 2 is a diagram of characteristics showing the electric field intensity of the received signals, and FIG. 3 is a flowchart illustrating the toll collection communication operation with respect to an on-the-road equipment.

Figure 4:
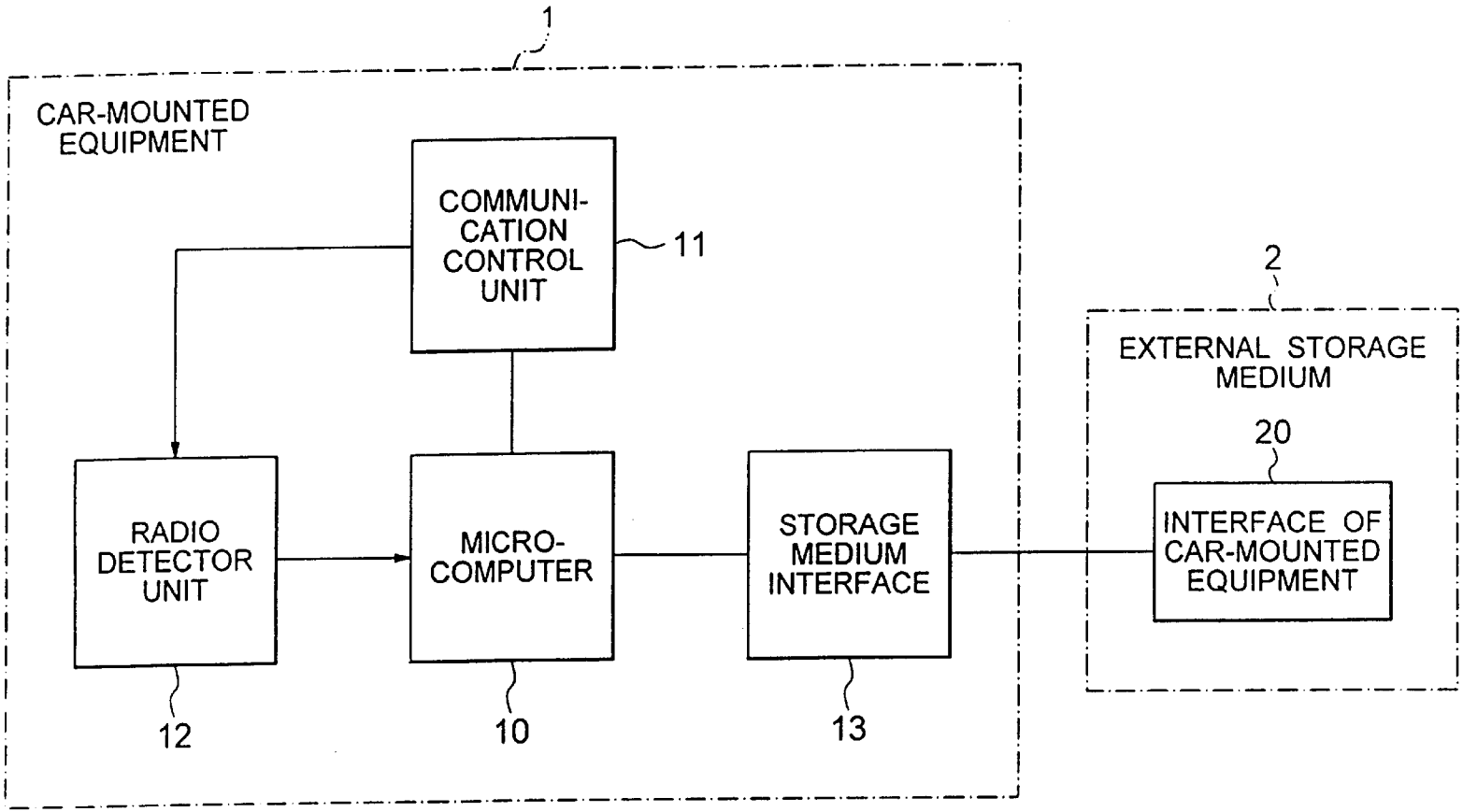
FIG. 4 is a block diagram schematically illustrating the constitution of a conventional DSRC car-mounted equipment.
Figure 5:
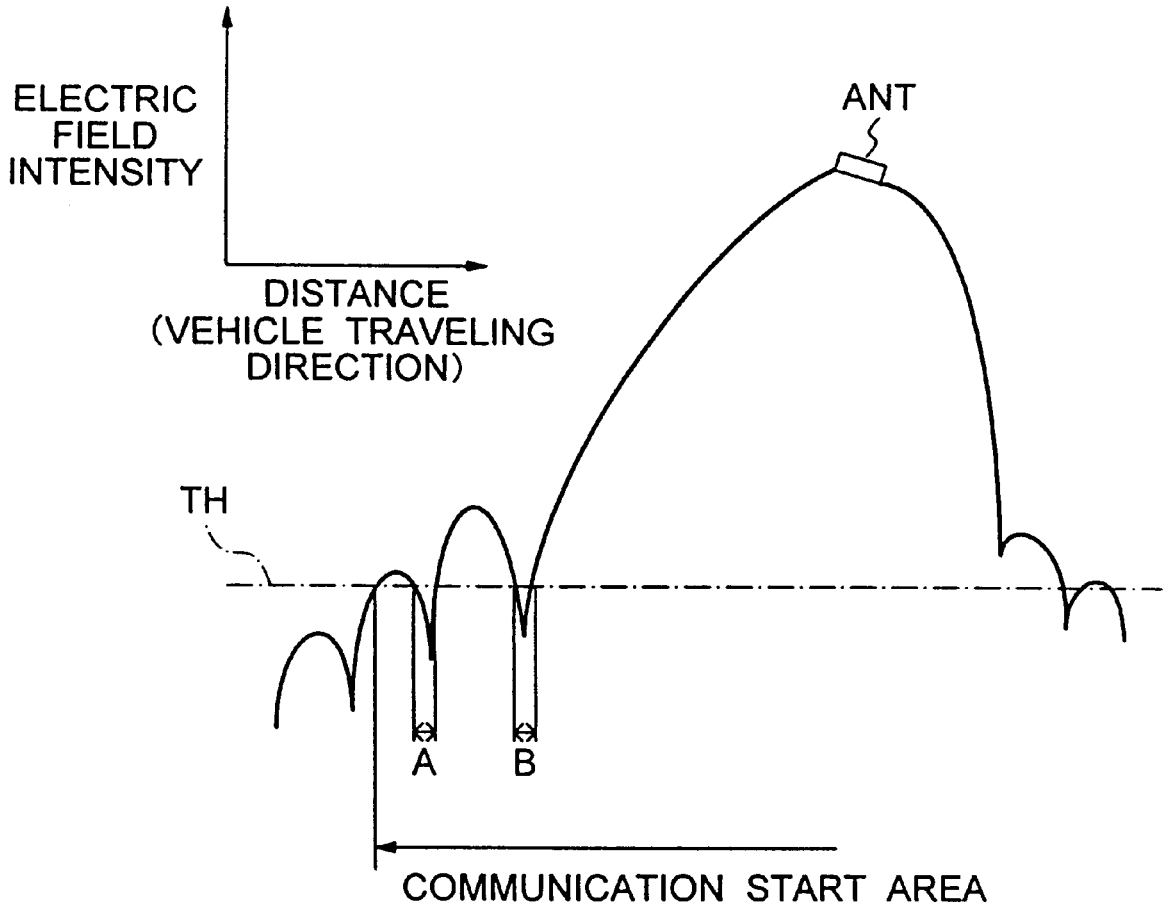
FIG. 5 is a diagram of characteristics showing the electric field intensity of signals received by the conventional DSRC car-mounted equipment.

FIGS. 1 and 2 correspond to FIGS. 4 and 5 described earlier, and wherein the portions similar to those described above are denoted by the same reference numerals, and the portions corresponding to those described above are denoted by the same reference numerals but to which are attached "A" but are not described again in detail.

In this case, too, the data communication for automatically collecting the toll is executed with respect to the on-the-road equipment installed on the toll road by using the ETC car-mounted equipment.

In FIG. 1, a car-mounted equipment 1A includes a microcomputer 10A for controlling the radio detector unit 12 via the communication control unit 11, and the storage medium interface 13 connected to the microcomputer 10A.

Though the external storage medium 2 (see FIG. 4) is not shown, the car-mounted equipment 1A is used for the automatic toll collection system which automatically collects the toll based on the data of the external storage medium 2.

The radio detector unit 12 includes a detector output unit 14, a system drive output unit 15 and an electric field intensity output unit 16, and the output signals of the output units 14 to 16 are input to the microcomputer 10A. The electric field intensity E detected by the radio detector unit 12 is input to the microcomputer 10A through the electric field intensity output unit 16.

The system drive output unit 15 described in relation to the radio detector unit 12 is not an indispensable component and may be omitted.

The microcomputer 10A is connected to a vehicle speed output unit 31 in a vehicle control unit 3, and fetches the vehicle speed data Vr from the vehicle speed control unit 3.

Though not diagramed herein, the microcomputer 10A includes an input interface for fetching the vehicle speed data vr and communication area-setting means for variably setting the radio communication area depending upon the vehicle speed data Vr.

The microcomputer 10A may be indirectly connected to the vehicle speed output unit 31 through a navigation system or the like.

The communication area-setting means in the microcomputer 10A contracts the communication area when the vehicle speed data Vr represents a low-speed state, and expands the communication area when the vehicle speed data Vr represents a high-speed state.

Concretely speaking, the communication area-setting means includes comparator means which compares the electric field intensity with predetermined judging levels (see LE1, LE2 in FIG. 2) to determine the communication area, and increases the judging level when the vehicle speed data Vr represents a low-speed state and decreases the judging level when the vehicle speed data Vr represents a high-speed state.

That is, the communication area-setting means changes the judging level in two steps by setting the judging level to a first judging level LE1 for low speed when the vehicle speed data Vr represents a low-speed state, and setting the judging level to a second judging level LE2 (<LE1) for high speed when the vehicle speed data Vr represents a high-speed state.

More concretely, the communication area-setting means compares the vehicle speed data Vr with a predetermined value corresponding to any speed within a range of from 5 km to 15 km per hour, contracts the communication area to become smaller than a normal communication area when the vehicle speed data vr is smaller than the predetermined value, and expands the communication area to become larger than the normal communication area when the vehicle speed data Vr is not smaller than the predetermined value.

The microcomputer 10A fetches the data received in the communication area that is set as described above, processes the data exchanged relative to the on-the-road equipment installed on the toll road, communicates data related to the toll collection between the on-the-road equipment and the external storage medium 2, and automatically executes the toll collection processing based upon these data.

Concrete operation of the embodiment 1 of the invention shown in FIG. 1 will now be described with reference to FIGS. 2 and 3.

In FIG. 1, the detection output unit 14, system drive output unit 15 and electric field intensity output unit 16 related to the radio detector unit 12, form a detection output, a system start output and an electric field intensity E as analog signals or digital signals of a minimum level (or smaller than a minimum level) specified by the standards.

In FIG. 2, the judging levels LE1 and LE2 for reception are shown in relation to a system drive level (see a two-dot chain line) and a predetermined level TH (see broken line).

In FIG. 2, there have been set a judging level LE1 (see a solid line) for low speed, which is larger than the above predetermined level TH, and a judging level LE2 for high speed, which is smaller than the above predetermined level TH.

The radio electric field intensity transmitted from the antenna ANT of the on-the-road equipment has been determined by the standards. Accordingly, the electric field intensity for determining the communication area for toll collection is calculated from a relationship between the vehicle speed data Vr and the toll collection communication time.

Digital levels LE1 and LE2 of two steps (low speed, high speed) were set depending on the vehicle speed data Vr as electric field intensity judging levels for determining the communication area. However, the analog levels may be set depending upon the vehicle speed data Vr.

The areas A, B in which the electric field intensity drops (and boundary areas) exist as regions of from several tens of centimeters to not less than one meter long though they may vary depending upon the physical arrangements of the antenna ANT of the on-the-road equipment and the car-mounted equipment 1A, as well as upon the communication environment such as presence of the preceding vehicles.

When, for example, the continuing communication-impossible region due to the areas A, B where the electric field intensity drops (and the boundary area) is 20 cm and the communication retrial permission time is 100 msec, the microcomputer 10A sets the judging level LE1 for low speed when the vehicle data Vr represents a speed of lower than 7.2 km per hour and sets the judging level LE2 for high speed when the vehicle data Vr represents a speed of higher than 7.2 km per hour.

Therefore, even when the radio communication is not successful in the boundary area (e.g., one meter) around the areas A, B where the electric field intensity drops with the vehicle speed data vr representing a speed of not smaller than 7.2 km an hour, the toll can be automatically collected by the retry processing.

The predetermined value with which the vehicle speed data Vr is compared is not limited to 7.2 km an hour but may be suitably set to any value within a range of from 5 km to 15 km an hour.

When running at a low speed of about 7.2 km an hour, the communication tends to become impossible since the vehicle stays in the areas A, B where the electric field intensity drops for extended periods of time (0.5 seconds or longer). In this case, therefore, the communication area is set to be narrow. When running at a speed of not lower than 7.2 km an hour, the vehicle does not stay long in the areas A, B where the electric field intensity drops and, hence, the communication area is set to be wide.

Figure 6:
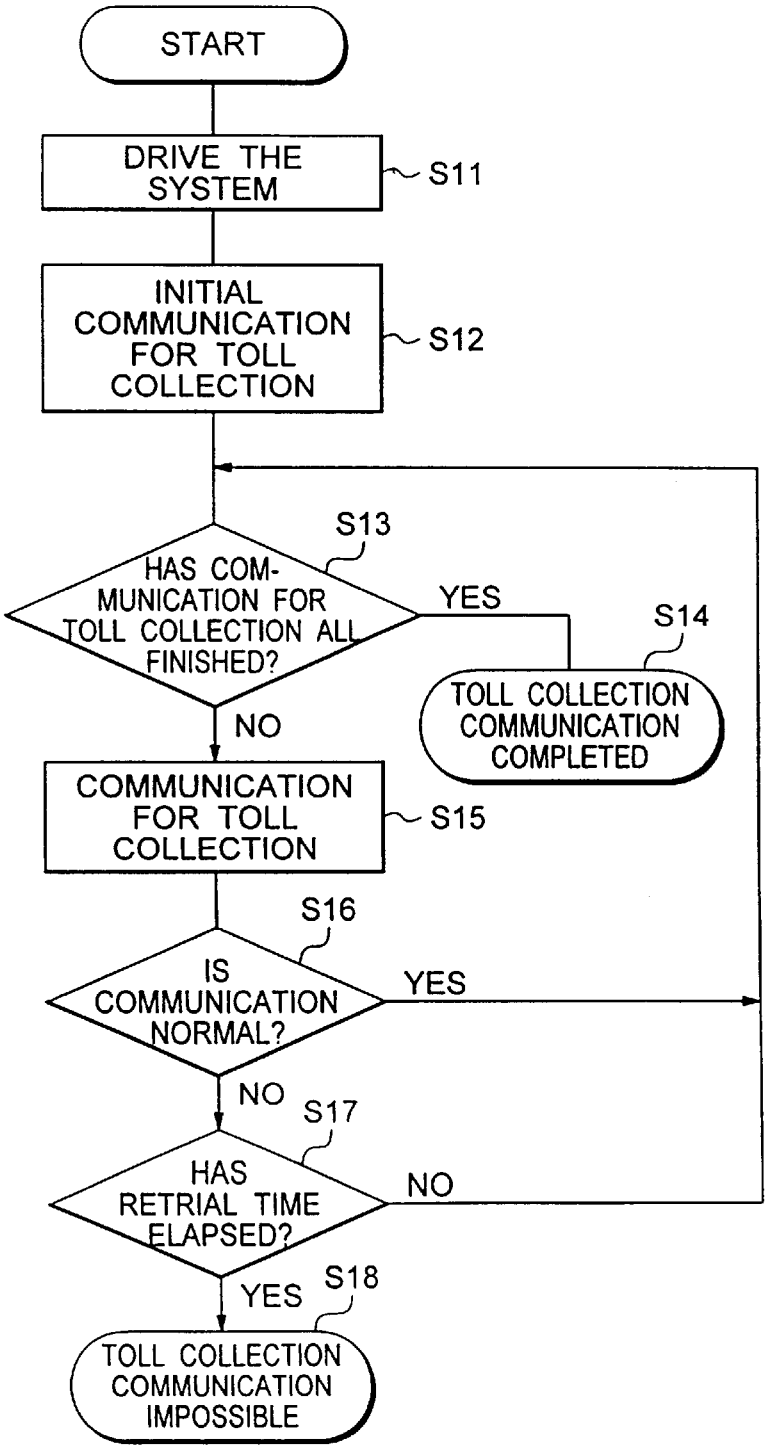
FIG. 6 is a flowchart illustrating the communication operation between the on-the-road equipment and the car-mounted equipment using the conventional DSRC car-mounted equipment.

In FIG. 3, the system start processing (step S1) and the toll collection communication processing (step S5) by the car-mounted equipment 1A are corresponding to the above-mentioned steps S11 and S15, respectively (see FIG. 6).

First, when a system start signal is received from the system drive output unit 15 in response to a reception signal larger than the system drive level, the microcomputer 10A in the car-mounted equipment 1A drives the system (step S1) and measures the vehicle speed by fetching the vehicle speed data Vr from the vehicle speed output unit 31 (step S2).

That is, the vehicle speed data Vr is compared with the predetermined value (7.2 km an hour) to set an electric field level for determining the communication range (step S3).

Here, the judging level LE1 for low speed or the judging level LE2 for high speed is set.

Then, the electric field intensity of the signal received from the antenna ANT of the on-the-road equipment is compared with the judging level (LE1 or LE2) to judge whether the car-mounted equipment is within the radio communication range (communication-possible area) (step S4).

When it is judged at step S4 that the received electric field intensity is larger than the judging level (LE1 or LE2)(i.e., YES), the microcomputer 10A executes the toll collection communication (step S5), and the routine returns back to step S2 to repeat the setting of the next judging level and communication.

Next, when it is judged at step S4 that the received electric field intensity is smaller than the judging level (LE1 or LE2) (i.e., NO), the toll collection communication processing (step S5) is not executed and the routine readily returns back to step S2.

Thus, based on the judging level (LE1 or LE2) set after the start of the system, the microcomputer 10A executes the toll collection communication processing based on the received data only when the received electric field intensity is larger than the level of electric field intensity determined by the judging level (LE1 or LE2).

That is, during the low-speed running as shown in FIG. 2, a stable communication area is maintained by reliably removing the effect of the areas A, B where the electric field intensity drops (and of the boundary area) relying on the judging level LE1 (solid line) which is a relatively high level.

In the communication area set by the judging level LE1 of when the vehicle is running at a low speed, the vehicle is closer to the antenna ANT of the on-the-road equipment than the would-be position of the vehicle in the prior art (see broken line). Therefore, a sufficiently high electric field intensity is obtained, and there exists no area A or B where the electric field intensity drops.

When running at a high speed, on the other hand, the car-mounted equipment is not almost affected by the areas A, B where the electric field intensity drops (and the boundary area). Therefore, a communication area of a sufficiently long period is maintained at an early time based on the judging level LE2 (a dot-dash chain line) which is a relatively low level.

Thus, a suitable communication area is set depending upon the vehicle speed data Vr, and the data can be reliably received and transmitted between the antenna ANT of the on-the-road equipment and the car-mounted equipment 1A.

That is, when the vehicle speed data Vr is small, failure of receiving the toll caused by the elapse of the permitted communication retrial time is prevented.

When the vehicle speed data Vr is large, performance of the radio detector unit 12 is utilized to a maximum degree to automatically collect the toll as the car-mounted equipment enters into the communication area again during the retrial despite the radio communication is not successful during a short period of time in the areas A, B where the electric field intensity drops.

Therefore, the data related to collecting the toll are reliably exchanged between the equipment 1A mounted on the vehicle traveling on a toll road and the on-the-road equipment at the toll gate irrespective of the running speed of the vehicle, making it possible to stably collect the toll based on the communication data.

Though the above embodiment 1 has dealt with the case of automatically collecting the toll by using the DSRC car-mounted equipment as the ETC car-mounted equipment, mounting the equipment 1A on the vehicle that travels on a toll road, and exchanging the data related to collecting the toll between it and the antenna ANT of the on-the-road equipment, the same actions and effects can be obtained even when the invention is adapted to other DSRC car-mounted equipment.

It needs not be pointed out that the communication area is variably set within a range that complies with the Wireless Telegraphy Act.

Embodiment 2

In the above-mentioned embodiment, the judging level was set in two steps (LE1, LE2). The judging level, however, may be set in three or more steps.

When the judging level is to be set in three steps, for example, the communication area-setting means in the microcomputer 10A compares the vehicle speed data Vr with two predetermined values, and sets the communication area to any one of a normal communication area, a communication area smaller than the normal communication area, or a communication area larger than the normal communication area.

That is, the communication area-setting means compares the vehicle speed data Vr with a first predetermined value and with a second predetermined value larger than the first predetermined value, and contracts the communication area to become smaller than the normal communication area when the vehicle speed data Vr is smaller than the first predetermined value and expands the communication area to become larger than the normal communication area when the vehicle speed data Vr is larger than the second predetermined value.

What is claimed is:

1. A DSRC car-mounted equipment comprising:

a communication control unit for transmitting and receiving data by radio to and from an on-the-road equipment installed on a road on which a vehicle travels;

a radio detector unit for detecting signals received from said on-the-road equipment by detecting the intensity of said radio electric field; and a microcomputer for fetching output signals from said radio detector unit by controlling said communication control unit to process data included in said received signals; wherein said microcomputer includes:

an input interface for receiving data related to the speed of said vehicle, and communication area-setting means for variably setting a radio communication area depending upon said vehicle speed data; and wherein said communication area-setting means contracts said communication area when said vehicle speed data represents a low-speed state and expands said communication area when said vehicle speed data represents a high-speed state.

2. A DSRC car-mounted equipment according to claim 1, wherein the communication area-setting means includes comparator means for comparing the intensity of said radio electric field with a predetermined judging level to determine said communication area, and increases said judging level when said vehicle speed data represents a low-speed state and decreases said judging level when said vehicle speed data represent a high-speed state.

3. A DSRC car-mounted equipment according to claim 1, wherein the communication area-setting means changes the judging level in two steps by setting the judging level to a first judging level for low speed when the vehicle speed data represents a low-speed state, and setting the judging level to a second judging level for high speed when the vehicle speed data represents a high-speed state.

4. A DSRC car-mounted equipment according to claim 3, wherein the communication area-setting means compares the vehicle speed data with a predetermined value corresponding to any speed within a range of from 5 km to 15 km per hour, contracts the communication area to become smaller than a normal communication area when the vehicle speed data is smaller than the predetermined value, and expands the communication area to become larger than the normal communication area when the vehicle speed data is not smaller than the predetermined value.

5. A DSRC car-mounted equipment according to claim 1, wherein the communication area-setting means compares the vehicle speed data with a first predetermined value and with a second predetermined value larger than the first predetermined value, contracts the communication area to become smaller than a normal communication area when the vehicle speed data is smaller than the first predetermined value, and expands the communication area to become larger than the normal communication area when the vehicle speed data is larger than the second predetermined value.

6. A DSRC car-mounted equipment according to claim 1, further comprising an external storage medium connected to the microcomputer to exchange data related to the collection of a toll, wherein the microcomputer exchanges data related to the collection of the toll between the on-the-road equipment installed on a toll road and the external storage medium, and automatically executes the toll collection processing based on the data related to the collection of the toll.

* * * * *